US007249988B2

(12) United States Patent
Bazant

(10) Patent No.: US 7,249,988 B2
(45) Date of Patent: Jul. 31, 2007

(54) LIFE PRESERVER

(75) Inventor: Tyler Francis Bazant, Vancouver (CA)

(73) Assignee: Mustang Survival Corp., Richmond, B.C. (CA)

( * ) Notice: Subject to any disclaimer, the term of this patent is extended or adjusted under 35 U.S.C. 154(b) by 30 days.

(21) Appl. No.: 11/218,517

(22) Filed: Sep. 6, 2005

(65) Prior Publication Data

US 2007/0054572 A1 Mar. 8, 2007

(51) Int. Cl.
*B63C 9/08* (2006.01)

(52) U.S. Cl. ..... 441/106; 441/88; 441/112

(58) Field of Classification Search ..... 441/88, 441/106, 112, 123
See application file for complete search history.

(56) References Cited

U.S. PATENT DOCUMENTS 1,400,976 A * 12/1921 Parmele ..... 441/123
3,750,205 A * 8/1973 Pfeifer ..... 441/123
3,931,657 A 1/1976 Jones
5,494,469 A 2/1996 Heath et al.
5,567,191 A 10/1996 Gordon
6,767,267 B2 7/2004 Miller
6,776,678 B2 8/2004 Courtney
2004/0033739 A1 * 2/2004 Courtney ..... 441/88

* cited by examiner

*Primary Examiner*—Jesus Sotelo
*Assistant Examiner*—Daniel V. Venne
(74) *Attorney, Agent, or Firm*—C. A. Rowley

(57) ABSTRACT

A personal flotation device is formed with a neck opening defined by a plurality of discrete lobes projecting in toward the inside of said neck opening and including a chin lobe that is positioned to engage the underside of the chin of a user when device is in operative position on said user and inhibit removal of said device over the head of the user. The chin lobe is spaced from adjacent portions of adjacent said lobes to provide spaces therebetween to facilitate donning and doffing of said device when said chin is aligned with one of the spaces. The device is also preferably provided with cover panels that releasably connect together around their peripheries so that the edges of the bladder contained between the cover panels may be folded and retained in folded position when the sides of the over panels are connected.

18 Claims, 10 Drawing Sheets

LIFE PRESERVER

FIELD OF INVENTION

The present invention relates to an inflatable personal flotation device. More particularly the present invention relates to a life preserver having an improved neck receiving opening and/or requiring minimum storage space.

BACKGROUND OF THE PRESENT INVENTION

There are many forms of personal life preservers or flotation devices available, some of which are inflatable and some non-inflatable flotation devices. It is also known to provide such life preservers or flotation devices in the form of jackets or vest and some are packaged in the pouch form for easy and compact storage prior to use.

U.S. Pat. No. 3,931,657 issued Jan. 31, 1976 to James discloses a jacket type that combines both buoyancy panels and inflatable bladders to support the user in the water. The inflatable bladders are strategically positioned in the collar so that the inflated bladder ensures that the user floats face up.

U.S. Pat. No. 5,567,191 issued Oct. 22, 1996 to Gordon provides an example of an inflatable jacket that includes its own package or pouch in which the inflatable jacket is contained prior to use. The jacket is specially construction and incorporates a rear portion that extends behind the user's head and a pair of legs located one on each side of the user's chest.

U.S. Pat. No. 5,494,469 issued Feb. 27, 1996 to Heath et al. describes a rectangular shaped inflatable vest with a collar and chest portions with a plurality of separate chambers or bladders isolated from each other so that if one is punctured the others that are not punctured will still remain inflated.

U.S. Pat. No. 6,767,267 issued Jul. 27, 2004 to Miller teaches the use of a self inflating necklace that is retained under the chin of an infant and that when submerged causes bladders to inflate radially outward relative to the neck and support the infant.

U.S. Pat. No. 6,776,678 issued Aug. 17, 2004 to Courtney describes specific positioning of bladders and a harness to hold the head face up in the water.

BRIEF DESCRIPTION OF THE PRESENT INVENTION

It is an object of the present invention to provide an improved life preserver that is restrained from slipping off over the head of the user.

It is a further object of the present invention to provide a pouch type life preserver which in its packaged form requires little storage space.

The most significant features of the present invention are believed to be: a novel neck design which allows inflated donning but retains the head upon impact jumps into water; an inflatable shape that optimizes the inflatable chambers in their desired peak performance locations; a completely reversible design; and a novel shape that accommodates the smallest packed configuration possible for efficiency in storage volume. The design offers a low weight, low packaged volume inflatable device that requires minimal maintenance and minimal storage space.

It is yet another object of the invention to provide a reversible life preserver.

Broadly the present invention relates to a personal flotation device comprising flotation panel means, a neck opening through said panel means, said neck opening being defined by a plurality of discrete lobes projecting in toward the inside of said neck opening and including a chin lobe, said chin lobe being positioned to engage the underside of the chin of a user when device is in operative position on said user thereby to inhibit removal of said device over the head of the user and wherein said chin lobe is spaced from adjacent portions of adjacent said lobes to provide spaces therebetween to facilitate donning and doffing of said device when said chin is aligned with one of said space.

Preferably, said neck opening is defined by three lobes symmetrically positioned around said neck opening.

Preferably, said flotation panel means comprises of an inflatable bladder means having a first bladder panel overlying a second bladder panel and closure seals sealing said bladder panels together around the outer periphery of said bladder panels and around the periphery of said lobes of said neck opening to define said inflatable bladder means.

Preferably, a first bladder defining seal connecting said bladder panels is provided extending on opposite sides of said chin lobe toward adjacent portions of said seals sealing said periphery of said bladder panels together to define a boundary between a chest support bladder portion and an intermediate bladder portion and to provide a passage connecting said chest bladder portion and said intermediate bladder portion.

Preferably, a second bladder defining seal spaced from said first bladder defining seal extends on opposite sides of said neck opening from the end of said neck opening remote from said chin lobe toward adjacent portions of said seals sealing said periphery of said bladder panels together to define the boundary between said intermediate bladder portion and a back support bladder portion.

Preferably, a partition bladder panel is interposed between said first and second panels and said closure seals seal said first, second and intermediate bladder panels together around the periphery of said panels and around said neck opening to define said bladder means as a pair of superimposed substantially identical flotation bladders.

Preferably, the device further includes outer cover panels including a pair of chest protective panels one on each side of said bladder means and pair of back protective panels also positioned one on each side of said bladder means.

Preferably, when in a packaged position the periphery of said bladder means is reverse folded to reduce the size of said bladder mean and is held in this form by said outer cover panels that are releasably held together by faster strips on the periphery of said cover panels.

Preferably when in packaged position the inflating devices for each bladder is visible through a window through its adjacent cover panel.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

The device 10 is intended to be used as a life preserver, preferably, an inflatable life preserver in commercial or industrial markets (.i.e.: ship passengers or professional crewmembers). Probably the most significant differentiating feature that the present invention offers that other devices do not are: novel neck design which allows inflated (as well as deflated) donning but impairs removal when in operative position by engagement under the chin of the user as will be described below to thereby retain the device on the user through impact jumps. In the inflatable version an inflated shape that optimizes flotation of the user in proper position through the use of suitably positioned and the completely reversible design and novel shape that accommodates packaging in a very small space for efficient storage volume.

Figure 1:
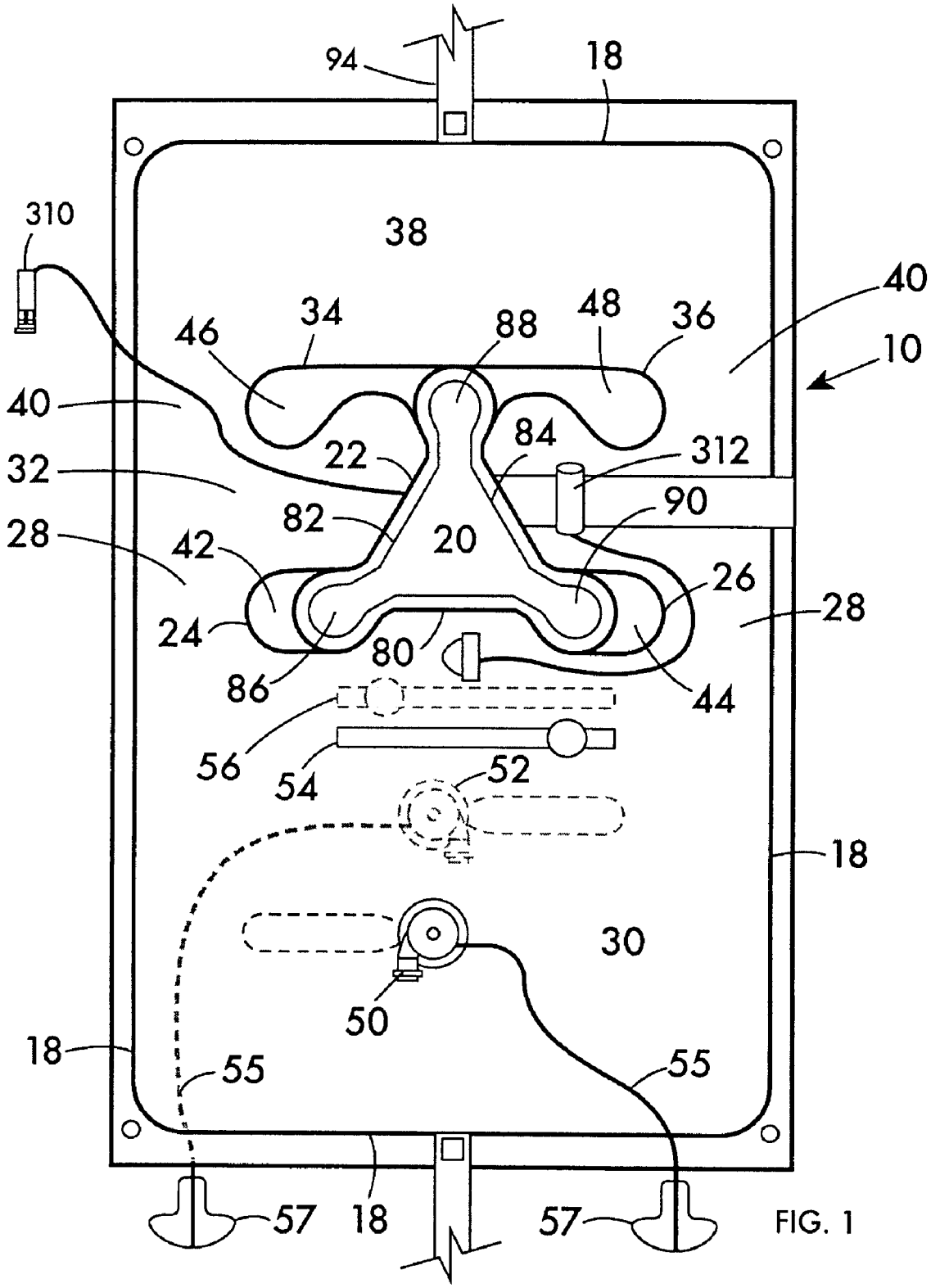
FIG. 1 is a plan view showing the front side of the bladder of the device with elements removed for clarity and showing the inflation devices on the rear side in dash lines.
Figure 2:
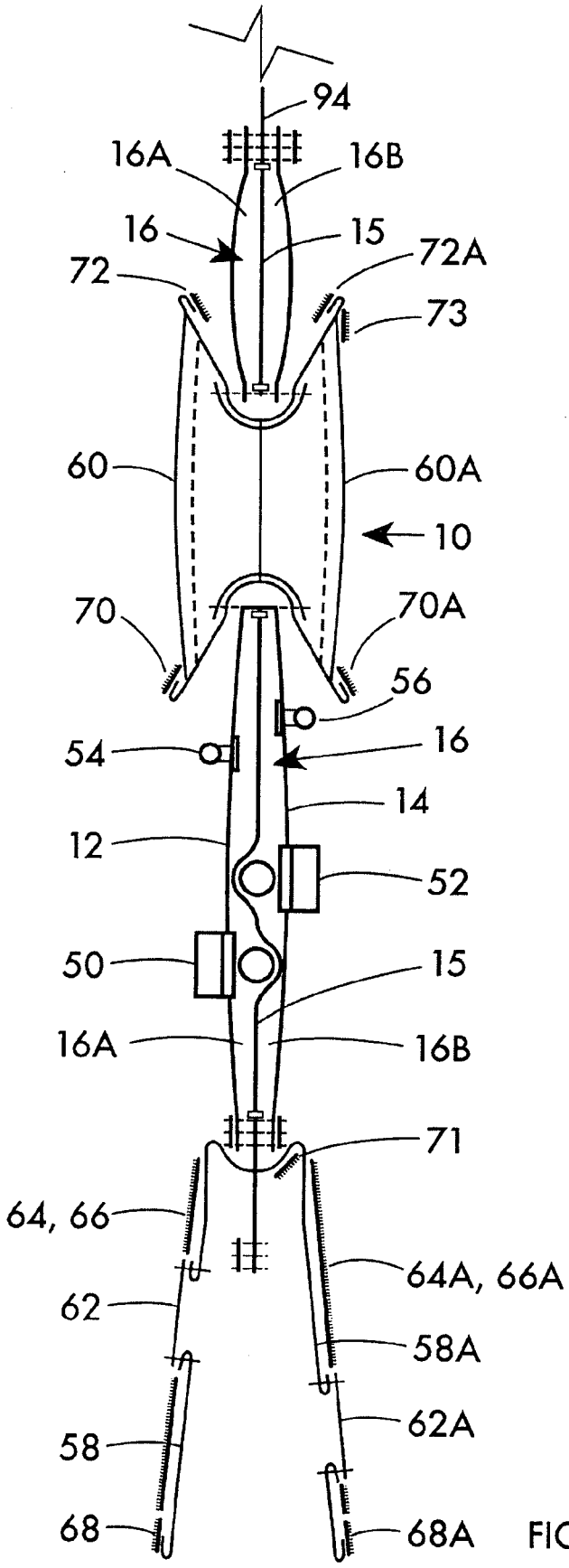
FIG. 2 is a schematic cross section along the line C-C in FIG. 1A.

Turning to FIGS. 1 and 2 the bladder 16 (see FIG. 2) of the inflatable personal floatation device of present invention is composed of substantially rectangular front and rear bladder panels 12 and 14 respectively sealed together (generally by welding) around periphery as indicated at 18 (see FIG. 1) to form an inflatable bladder 16 that extends over substantially the full extent of the panels 12 and 14. A neck opening 20 is defined by a neck seal 22 similar to the seal 18 that seats the bladder 16 around the neck opening 20. An intermediate or partition bladder panel 15 similar to the bladder panels 12 and 14 is interposed between the panels 12 and 14 and is sealed to these panels 12 and 14 by the peripheral and neck seals 18 and 22 to divide the bladder 16 into a pair of substantially identical bladders 16A and 16B to provide redundancy should one of the bladders 16A or 16B leak. Obviously if desired the dividing panel 15 could be omitted, but this would eliminate an important safety feature of the inflatable embodiment of this invention.

A pair of dividing seams 24 and 26 extend laterally from each side of the front or chest side of the neck opening 20 toward the adjacent portion of the peripheral seal 18 to provide a passage 28 between the seam 18 and each of these seam 24 and 26 to permit air to flow therethrough. The seams 24 and 26 and the interconnecting part of the seal 22 adjacent to a chest bladder portion 30 of the bladder 16 define a boundary between the chest bladder portion 30 and an intermediate bladder portion 32.

Seams 34 and 36 similar to the seams 24 and 26 respectively extending from opposite sides of the neck opening 20 at the side of the neck opening 20 remote from the chest bladder portion 30 to define the boundary between the intermediate bladder portion 32 and a back bladder portion 38. Passages 40 similar to the passages 28 between the seam 18 and the seams 34 and 36 connect the bladder portions 32 and 38. Making the seams 24, 26, 34 and 36 substantially U shaped and sealing the panels 12 and 14 (and 15 if present) together at these seams produces uninflated areas 42, 44, 46 and 48 which facilitate shaping the device 10 over the shoulders and permits obtaining the desired inflated shape of each of the chest, intermediate and back bladder portions 30, 32 and 38 respectively.

It will be apparent that when the partition panel 15 is used there will be passages and bladder portions equivalent to passages 28 and 40 and bladder portions 30, 32 and 38 in each of the bladders 16A and 16B.

An inflator assembly 50 is mounted on the front panel 12 and a second inflator assembly 52 (shown in FIG. 2 and in dash lines in FIG. 1) is mounted on the rear panel 14. Each inflator assembly 50 and 52 includes its operating lanyard as indicated at 55 and exposed activation handle or grip 57. Similarly an oral inflator tube 54 is provided on the front panel 12 and an oral inflator tube 56 is provided on the panel 14. By providing these inflation elements (in both panels 12 and 14 the device is made reversible so the either the panel 12 or the panel 14 may be placed adjacent to the user. It will be apparent that when the partition panel 15 is present as normally will be the case the inflator assembly 50 and tube 54 will connect to and be used to inflate the bladder 16A and the inflator assembly 52 and tube 56 to inflate bladder 16B.

Figure 1A:
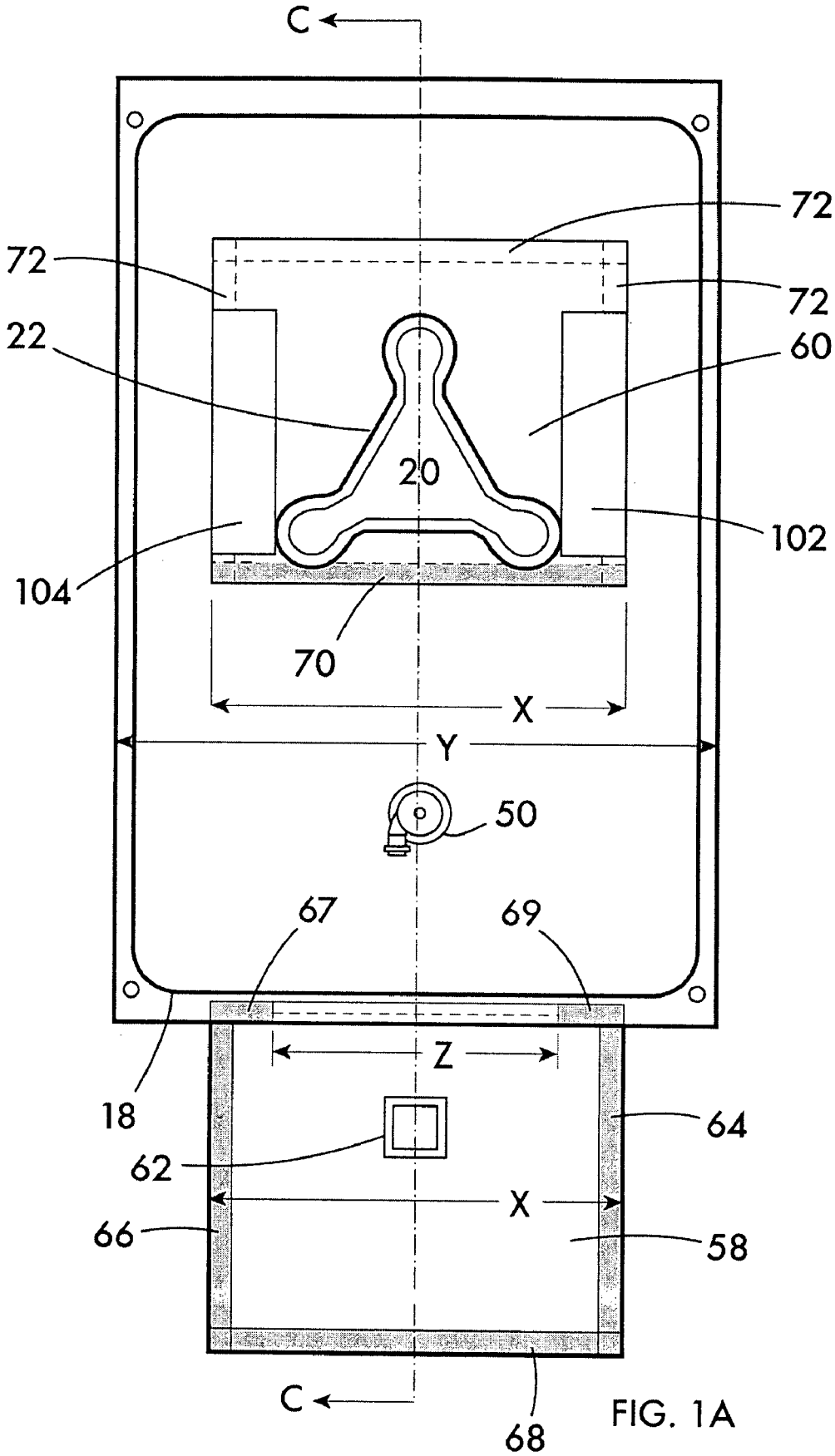
FIG. 1A is a view similar to FIG. 1 but showing the cover sheets (on one side of the device) with elements removed for clarity.

Turning to FIG. 1A which shows the open (or deployed) cover flaps or panels between which the bladder 16 is encased when the device 10 is in packed position as will be described below. As shown there are a pair of chest protective panel 58 and 58A and pair of back protective panels 60 and 60A. These panels 58, 58A, 60 and 60A have a width X smaller than the width Y of the bladder in extended position as shown in FIG. 1A so that when bladder 16 when folded as will be described below is contained with the width X.

The chest protective panels 58 and 58A are connected to the bladder 16 on the outside of seal 18 and are centered on the narrow end of the chest portion of the bladder 16 i.e. the portion of seal 18 sealing the end of bladder portion 30 remote from the head opening 20. The attachment of bladder 16 to the panels 58 and 58A do not extend the full width Y of panels 58 and 58A as indicated by the distance Z which also is symmetrical with the centre line of the bladder 16 so that the panels 58 and 58A are free from the bladder 16 for a short distance to provide a flap. Fastener strips 67 and 69 (generally of the hook and loop type fastener) and corresponding fastener strips (not shown) on the panel 58A cooperate to hold the so formed flaps on the panels 58 and 58A together when the device 10 is in packaged condition.

The covers 58 and 58A are substantially identical except for the fact that the window 62 and 62A in the panels 58 and 58A are offset from each other and in position so that the inflating device 50 and 52 are visible through the window 62 and 62A, respectively when these panels 58 and 58A are in their packaged positions. Each of the panels 58 and 58A has a pair of side fastener strips (generally of the hook and loop type fastener) as indicated at 64 and 66 and 64A and 66A in FIGS. 1A and 2. e.g. the strips 64 and 64A will combine to hold one side of the panels 58 and 58A together and the strips 66 and 66A will combine to hold the other side of the panels 58 and 58A together and thereby contain the bladder 16 therebetween as will be described below. An end strip fastener 68 and 68A (generally of the hook and loop type fastener) is provide on the panels 58 and 58A respectively i.e. along the free end of the panels 58 and 58A as shown in FIG. 1A and in position to cooperate with their respective mating strip fasteners 70 and 70A along the adjacent edge of the back protective panel 60 and 60A.

Figure 5:
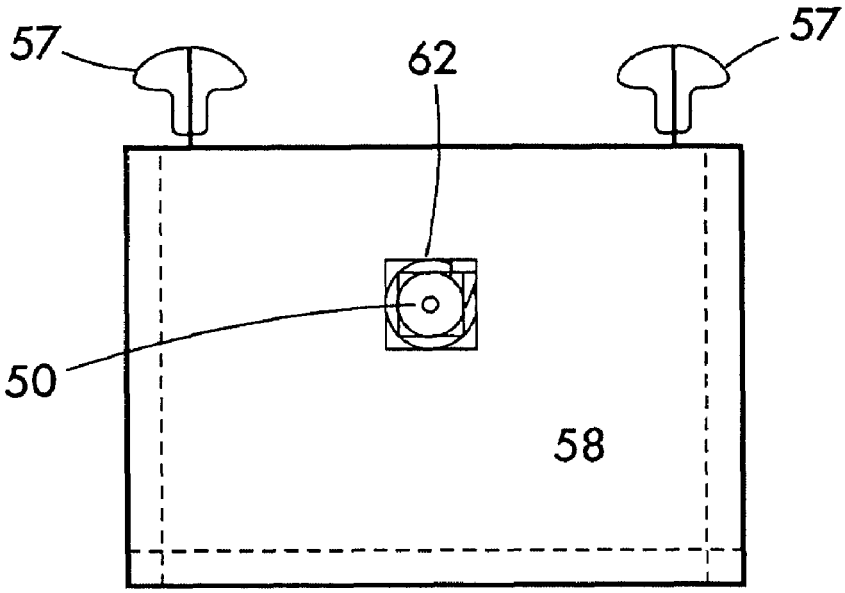
FIG. 5 is a rear plan view showing the device in packaged form.
Figure 6:
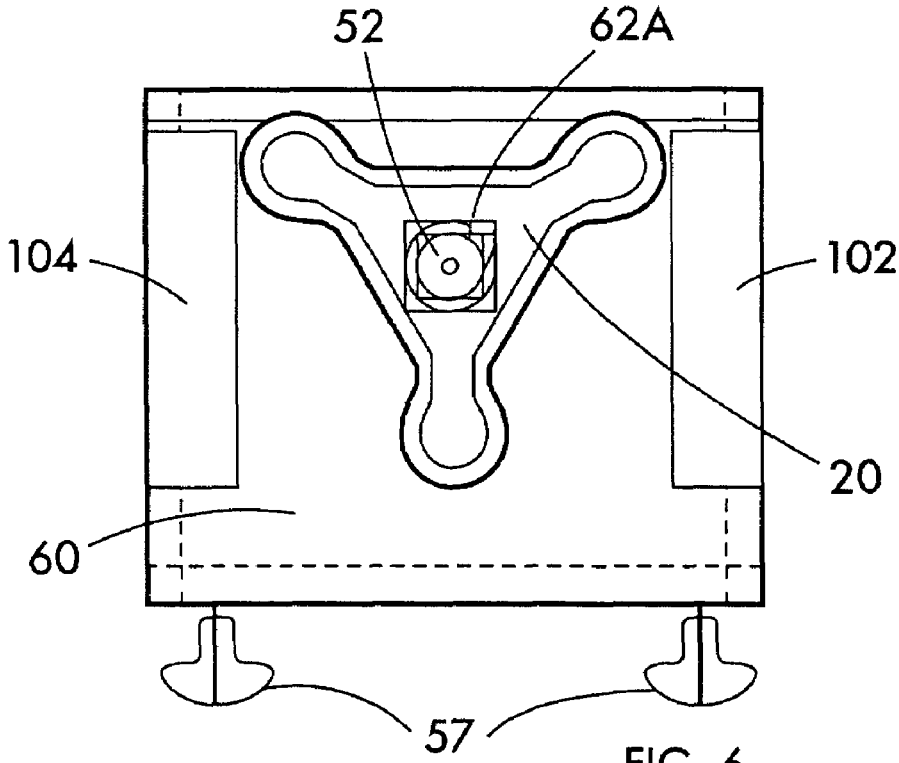
FIG. 6 is a front plan view showing the device in packaged form.

A retainer strip fastener 71 (generally of the hook and loop type fastener) is provide along the fixed edge of the panel 58 or 58A (i.e. adjacent to the seam 18) and is used to cooperate with a second retainer strip fastener 73 on the panel 60 or 60A on the same side of the device 10 as the strip 71 so that when the device 10 is in the final packaged and folded position as shown in FIGS. 5 and 6 the fastener strips 71 and 73 cooperate to hold the device 10 in this configuration.

The panels 60 and 60A are essentially mirror images of each other. Each is connected to the bladder 16 via the seal 22 around the neck opening 20 so that the edges of the panels 60 and 60A remote from the seal 22 are free edges (i.e.: are not connected to bladder portion 32 or 38). As above indicated panel 60 and 60A has its respective outward facing strip connector 70 and 70A respectively that cooperates with the adjacent strip 68 and 68A respectively as described and the panels have their respective inwardly facing connector strips 72 and 72A that extend around the remainder of their respective peripheries i.e. along the sides and end of the cover 60 and 60A respectively. The strips 72 and 72A cooperate to enclose the back and intermediate portions of the bladder 16 when the device 10 is in packaged condition as will be described below.

Neck Retention:

The shape or periphery of the neck opening or hole 20 is specifically designed with a plurality of lobes projecting in toward the user i.e. into the hole 20. Preferably there will be 3 such lobes as indicated at 80, 82 and 84 separated at their adjacent sides by slot shaped openings 86, 88 and 90. Preferably the lobes 80, 82 and 84 are symmetrically positioned about the neck opening or hole 20. The lobe 80 which provides a chin engaging lobe 80 and its position are very important and the size or width of the slots particularly slots 86 and 90 also must be sufficiently wide and long to accommodate the chin when the device is being donned or doffed as will be described below.

This neck design allows the personal flotation device (PFD) 10 to be donned when in inflated operable condition, but effectively retains the PFD in position when jumping into the water in both the inflated, and also potentially in the uninflated condition as well. Traditional PFD's have to rely on harness strapping to retain it's position, but often the strapping is confusing to properly don (especially in an emergency). Where there is insufficient strapping to secure the PFD, the inflatable devices of the prior art will most likely come off when the user jumps into the water (also known as "impact"). The specific design of the neck hole 20 acts to easily allow the head to pass through with the device inflated when donning, but not for doffing. The lobe 80 on the front of the neck hole 20 is located to fit directly under the chin of the user helps to properly support the head on impact. The (typically looking forward) chin acts as a barb, and the PFD does not easily "pop-off" the head. However, if the head is rotated about 30 degrees to the left or right of center, the chin lines up with the open area or slot 86 or 90 between the chin lobe 80 and adjacent lobes 82 or 84 respectively defining the neck hole 20. This opening or slot 86 or 90 is sized and the flexibility of the lobes when inflated or deflated are designed to allow when the chin of the user is substantially aligned with the longitudinal axis of the slot 86 or 90 and the head to pass through the neck opening 20 for donning or doffing. The lobes 80, 82 and 84 in operative position (inflated) are preferably sized to apply light pressure on the neck of the user.

This feature of the neck opening 20 makes the requirement for the presence of the back strap system 92 (see FIG. 4) optional. The 3 inflatable lobes 80, 82 and 84 create a simple minimum constraint design solution for retention on complex shapes.

Figure 3:
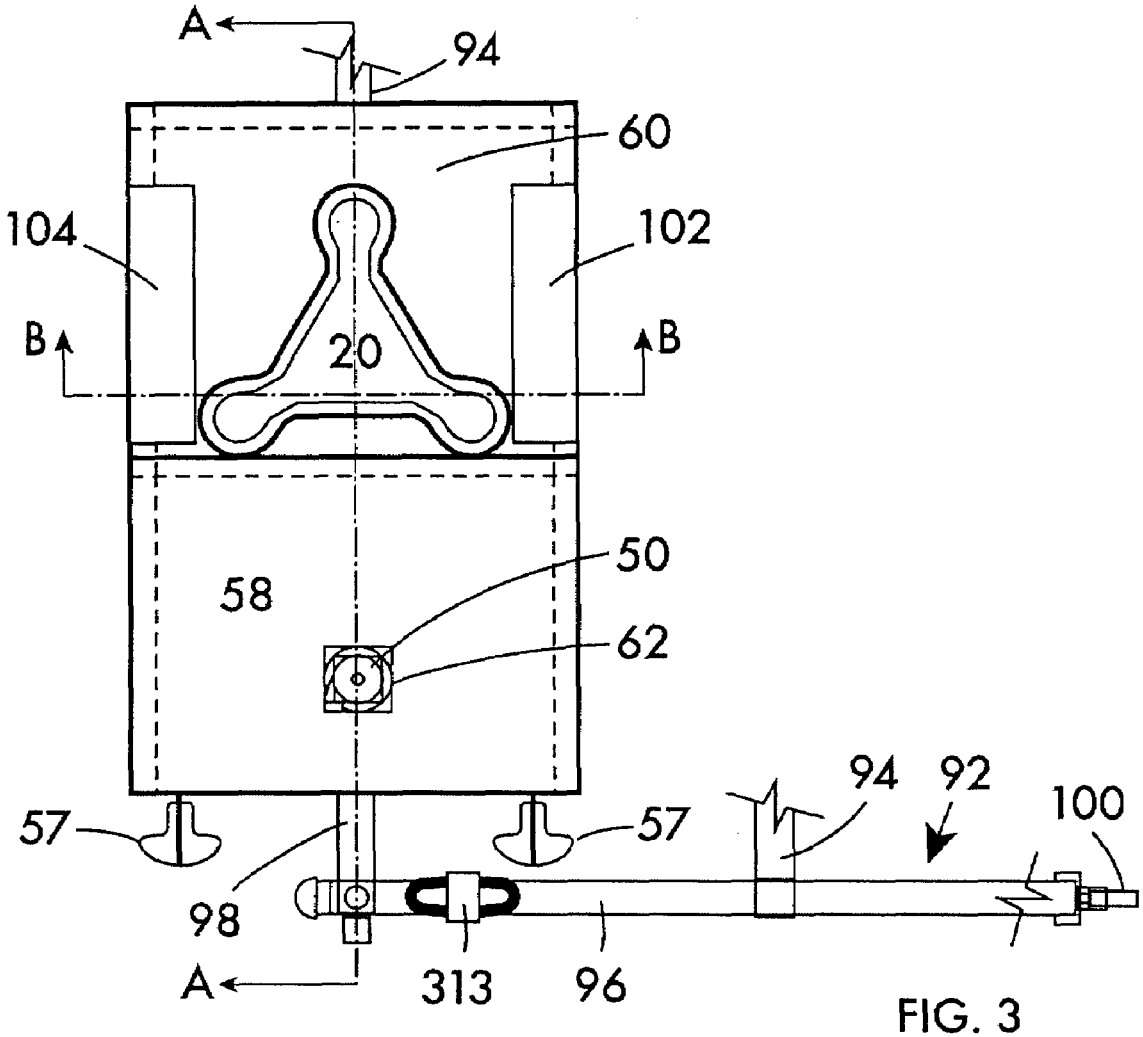
FIG. 3 is a front plan view showing the device in packed but unfolded condition.
Figure 4:
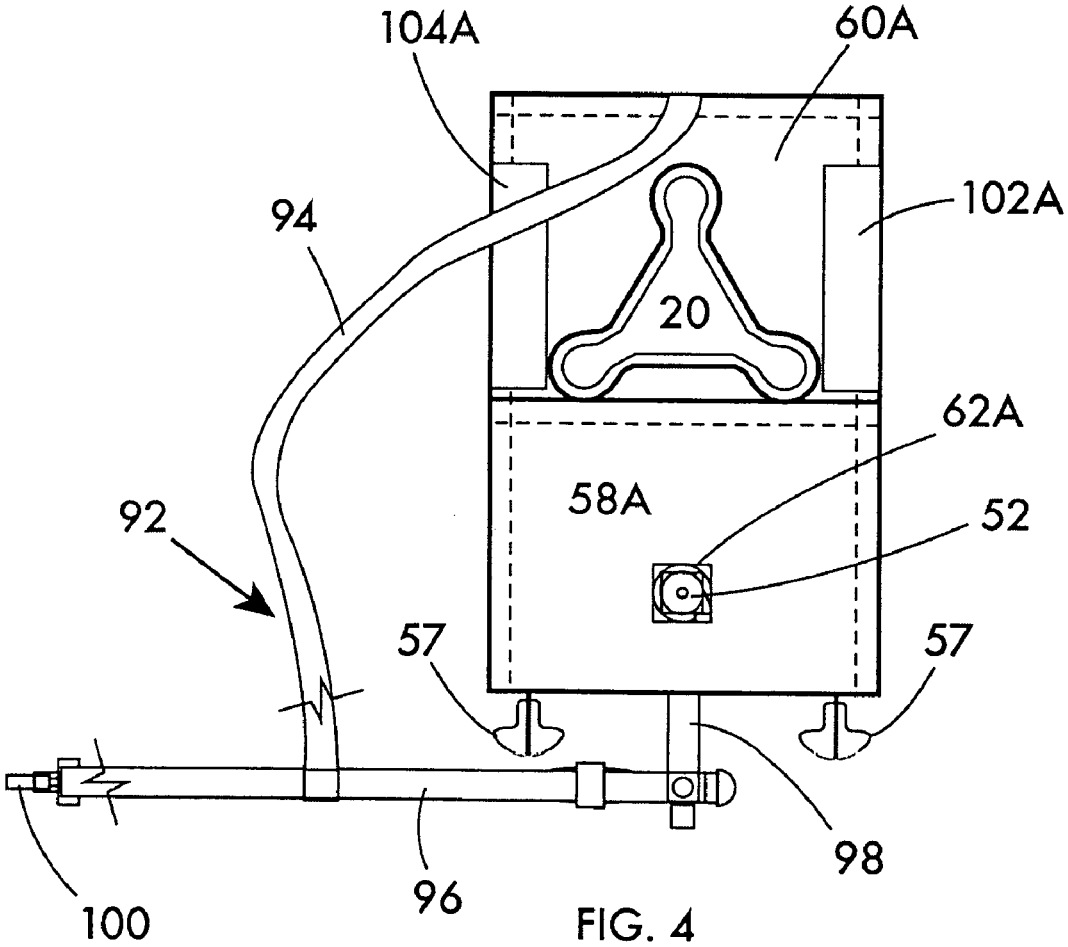
FIG. 4 is a rear plan view showing the device in packed but unfolded condition.

If it is decided to include the back strap system 92 to create an even higher freeboard (and hence provide a more conservative performing device), the strap system 92 will normally include a back strap 94 extending from the centre of the back to a belt 96 which is suspended from the bottom edge of front or chest portion by a strap 98 (see FIGS. 3 and 4). The belt 96 is intended to encircle the waist of the user and be coupled together by a suitable clasp 100.

Figure 3A:
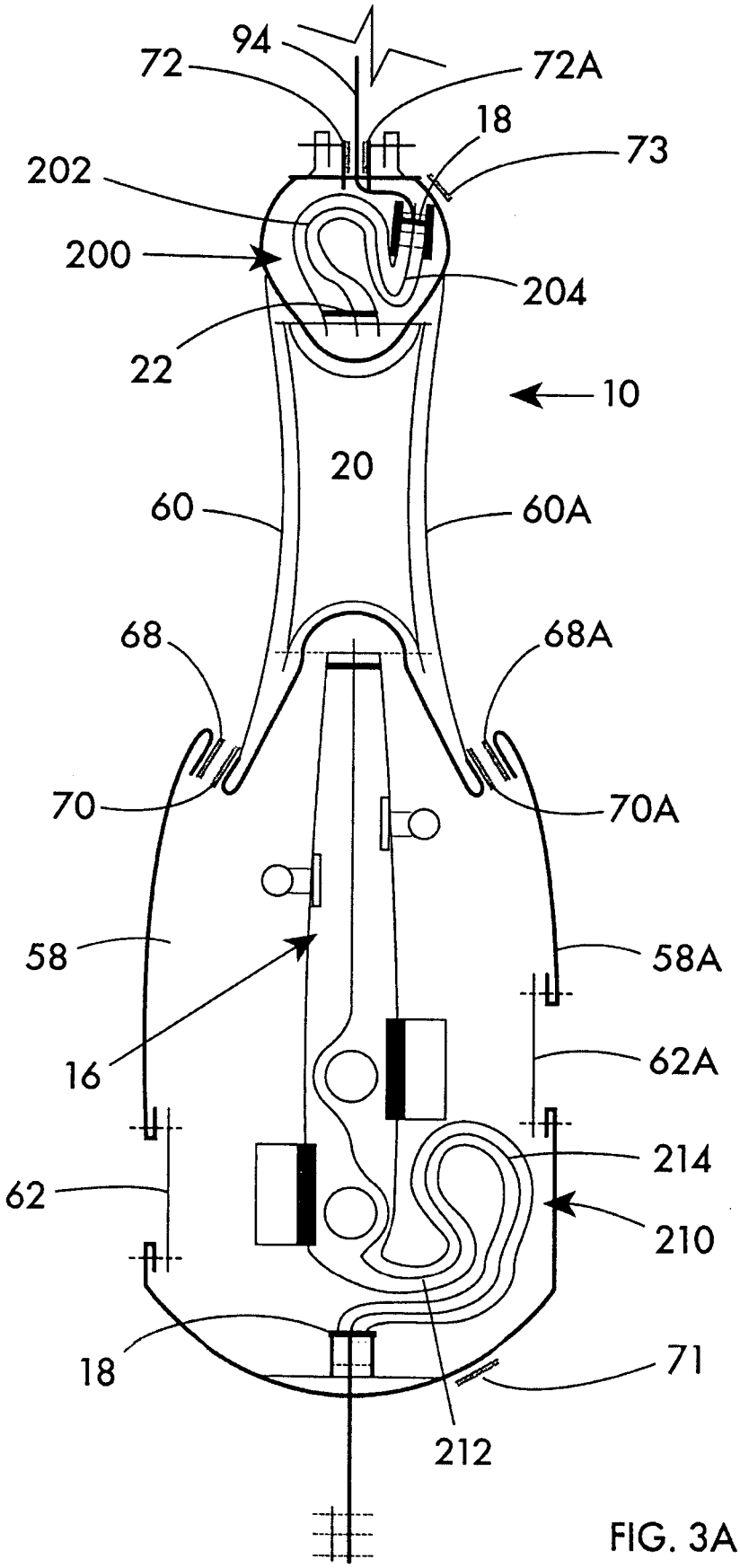
FIG. 3A is a schematic cross section along the line A-A in FIG. 3.
Figure 3B:
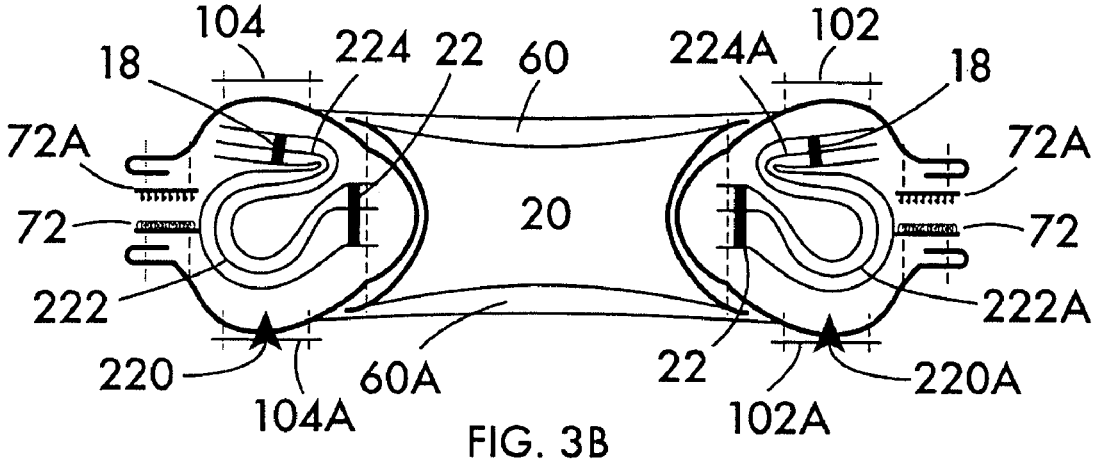
FIG. 3B is a schematic cross section along the line B-B in FIG. 3.

Another safety feature that normally will be provided are strips of reflective tape 102 and 104 positioned along opposite side edges of the cover panel 60 and similar strips 102A and 104A positioned in opposed positions along the edges of the cover panel 60A Forming the device into a packaged condition will now be described with reference to FIGS. 3, 3A and 3B . The sequence of folding up the side edges is not particularly important so we will begin with the folded assembly 200 at the top of the device 10 as shown in FIG. 3A. As is apparent the bladder 16 is folded back over itself at the fold 202 and the back again in a reverse fold 204 so that the end portion of the seam 18 adjacent to the neck opening 20 again faces outward relative to the centre of the device 10. The cooperating fastener strips 72 and 72A along the end of the panels 60 and 60A are coupled together to hold the fold 200 in position.

A similar but larger folded assembly 210 is formed at the opposite end of the bladder which is folded back over itself at the fold 212 and the back again in a reverse fold 214 so that the end portion of the seam 18 again faces outward relative to the centre of the device 10. Side folds 220 and 220A positioned along the full length of the bladder 16 are formed by folding the bladder 16 back over itself at the fold 222 and 222A and the back again in a reverse fold 224 and 224A so that the side portions of the seam 18 again face outward relative to the centre of the device 10 (see FIG. 38). The side portions of the fastener strips 72 and 72A are fastened together as in FIG. 3B. The cover panels 58 and 58A are moved into position on opposite sides of the bladder 16 so tat the strips 68 and 68A mate with the strips 70 and 70A (see FIG. 3A) to hold the panels 58 and 58A in position and the fastener strips 64 and 64A and 66 and 66A (FIG. 2) are coupled together to enclose the folds 220 and 220A. The short strip 67 and its corresponding strip (not shown) and the short strip 69 and its corresponding strip (not shown) are connected together to complete the enclosing of the folds 200, 210, 220 and 220A. The chest portion 30 of the bladder 16 is then folded over the intermediate and back bladder potions 32 and 38 (FIG. 1) and the fastener strips 71 and 73 (FIG. 3A) hold the device in folded packaged condition as shown in FIGS. 5 and 6.

Figure 7:
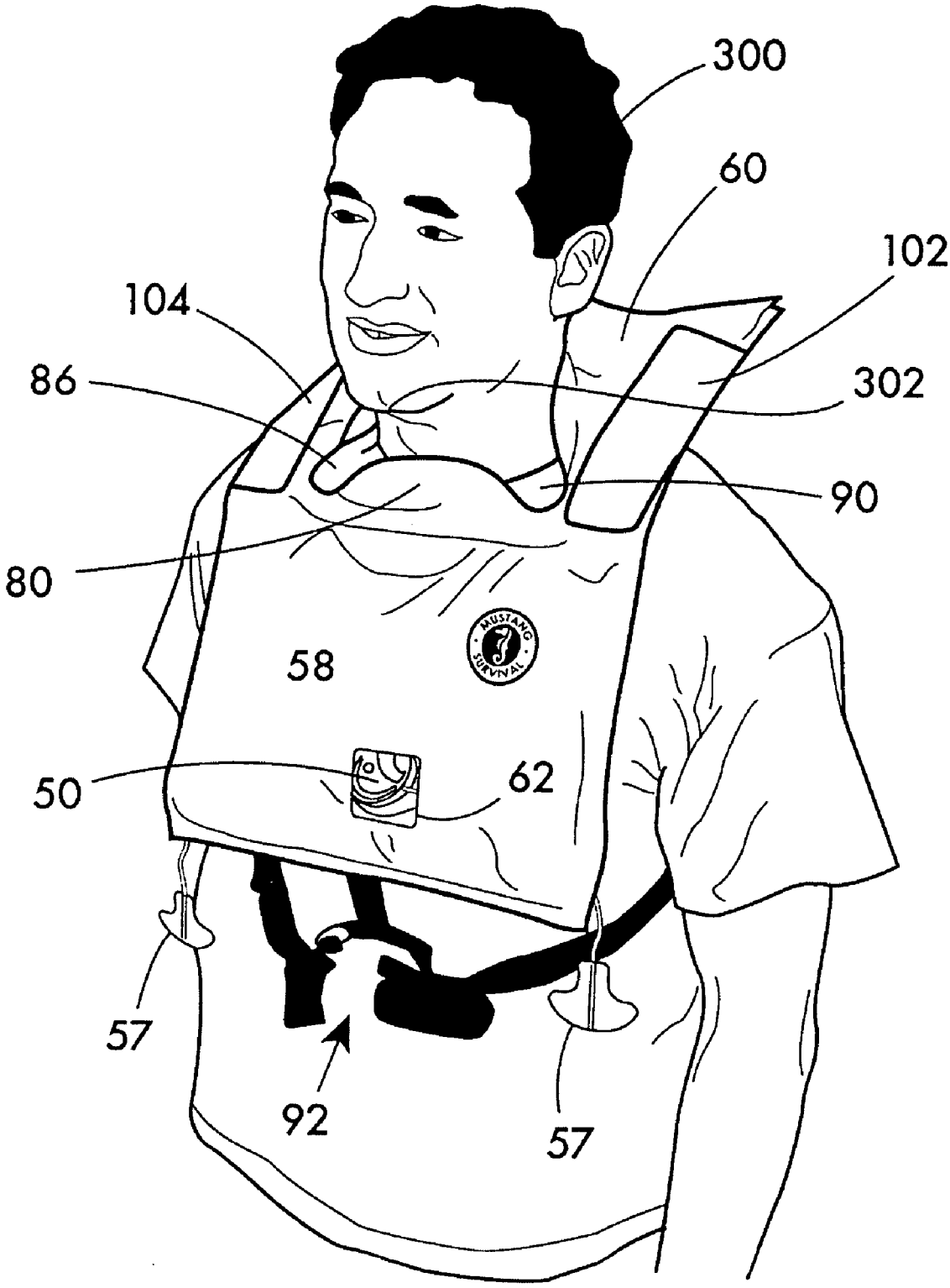
FIG. 7 is an isometric illustration view showing the device in position on a user prior to inflation.

In use the device 10 may be donned with either the cover 58 and 60 or 58A and 60A exposed by separating the fasteners 71 and 73 and slipping the head through the head opening 20. Normally the chin will be aligned with one of the spaces 86 or 90 on opposite sides of the chin lobe 80 and the device 10 turned to the position shown in FIG. 7 with the chin lobe 80 directly under the chin 302 of the user 300. In the position shown in FIG. 7 the device 10 i.e. bladder 16 has not been inflated thereby facilitating practice drills without activating the inflators.

Figure 8:
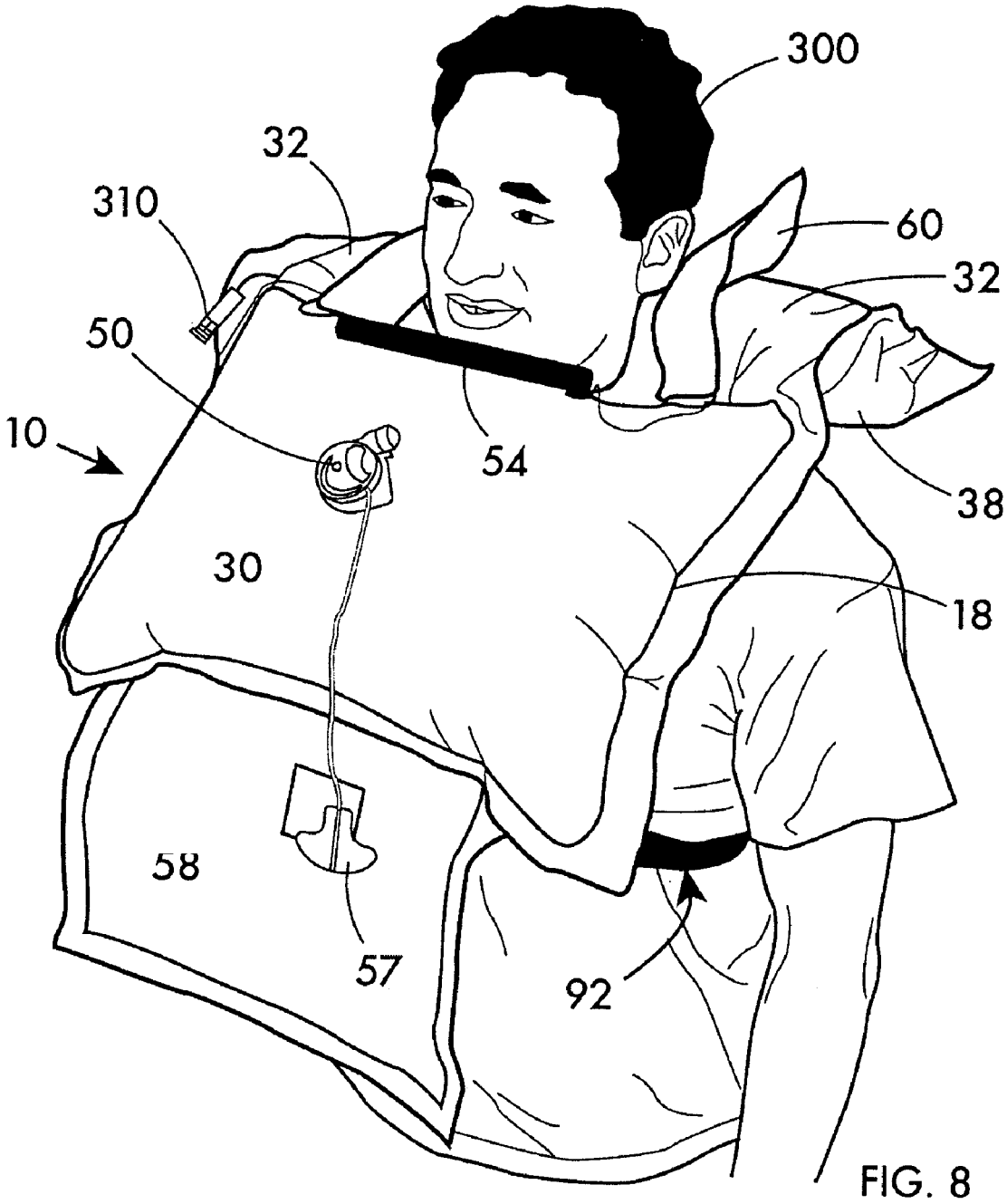
FIG. 8 is an isometric illustration showing the device in position on a user after to inflation.

FIG. 8 shows the device 10 inflated which causes the connection between the fastener strips at the sides 64, 64A, 66 and 66A and back end 72 and 72A of the device 10 to release and the exposed cover panel 58 or 58A (remote from the user 300) to fall from and expose the bladder 16 after release of the middle fastener 68, 68A, 70 and 70A.

Figure 9:
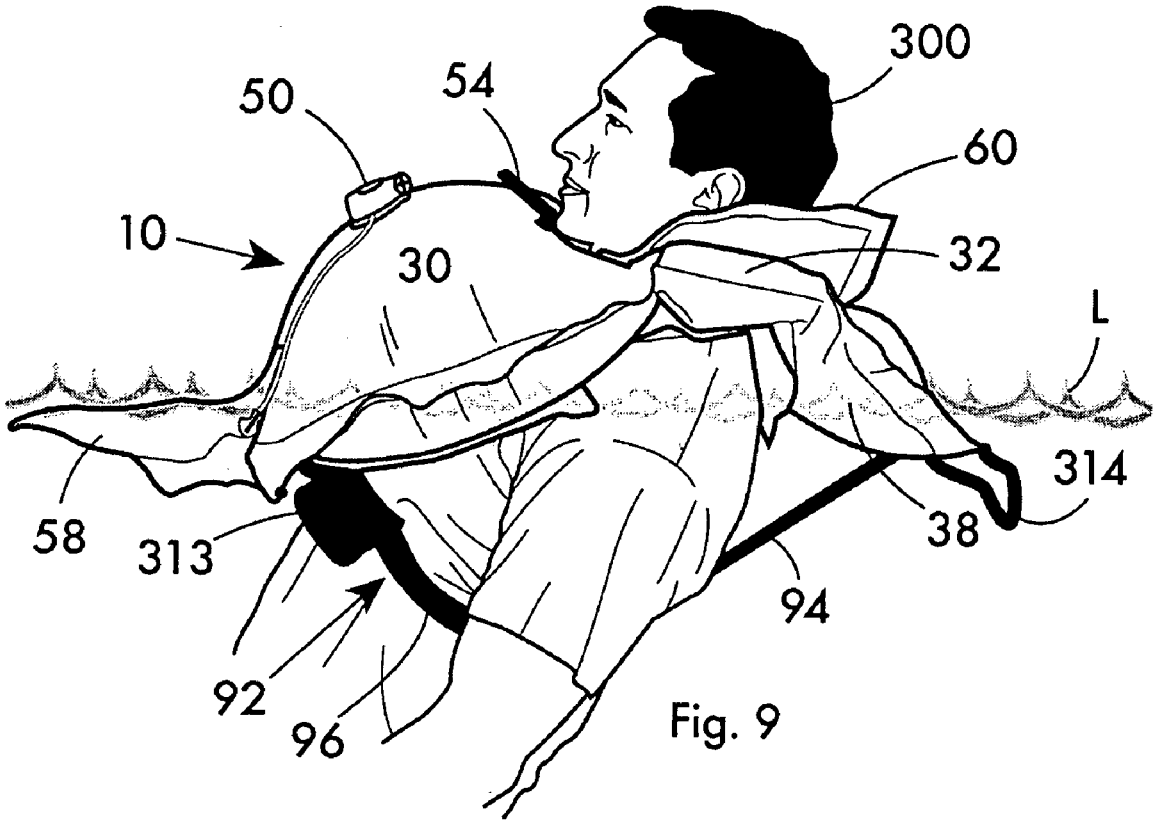
FIG. 9 is an illustration showing the device in inflated condition supporting a user in the water.

FIG. 9 shows the user floating in the water having a level L and how the bladder portions 30, 32 and 38 cooperate to hold the user in proper orientation in the water.

There are 3 difference configurations of the device: "stored" (packaged and folded, FIGS. 5 and 6), "donned for training" (FIG. 7), and "operational" (FIGS. 8 and 9). The first two are uninflated while the later is inflated. The "stored" or fully packaged configuration represents its physical form when it is stored or not in use in a non-emergency situation. It is intended to be stored in significant numbers adjacent to one another. The "donned for training" configuration represents when the device has been taken out of storage and is issued to an individual for training purposes (on the devices operation) or preparation for an emergency. The "operational" configuration represents the device after activation (i.e.: inflation by carbon dioxide gas stored in small cylinders or orally inflated) when it is intended to be used as a life preserver or life saving device. In all 3 configurations, the appearance of the product is in a rectangular form, primarily for efficient packing and folding into a discreet volume.

When in any configuration (i.e.: "stored", "donned for training" or "operational"), the status of the inflation systems can be observed for indication of armed readiness. The windows 62 and 62A on the device 58 and 58A and location of the inflation systems 50 and 53 allow both chambers of the bladder 16A and 16B to be viewed on both the top and bottom side of the device, even when folded into the "stored" configuration. This is made possible by locating the device 52 and its window 62A so that they are aligned with the neck opening 20 (see FIG. 6). The device 50 and its window 62 are on an exposed side of the device 10 and thus are visible to the user when view from the side covered by the panel 58.

The entire device 10 may or may not be protected by an environmental seal, likely vacuum packaged. The seal will be easily torn open by the user if the device is needed, but will be sealed to protect it during prolonged storage (primarily to prevent humidity from prematurely activating the device).

The device 10 may contain other accessories that enhances its performance in the water such as: whistle 310, emergency light and automatic activation lanyard 312 (see FIGS. 1, 4, 8 and 9), reflective tape 102, 102A, 104 and 104A, buddy securing line 313 and lifting strap 314.

Each accessory is reversible so it can be used by either hand and from either position if the life jacket is donned top-side down or bottom-side down (i.e.: with either cover side facing the body). The entire life jacket is "reversible" so that it can be donned upside down (i.e.: top-side in toward the body) and still fully function to all desirable performance criteria: floatation characteristics (freeboard, body and face floatation angles, self-righting ability, jump impact, mobility, etc. . . . ), structural integrity, sizing accommodation and similar form, fit and function variables.

Having described the invention, modifications will be evident to those skilled in the art without departing from the scope of the invention as defined in the appended claims.

I claim:

1. A personal flotation device comprising a flotation panel, a neck opening through said flotation panel, said neck opening being defined by three lobes symmetrically positioned around said neck opening each projecting in toward the inside of said neck opening and including a chin lobe, said chin lobe being positioned to engage the underside of the chin of a user when said device is in operative position on said user thereby to inhibit removal of said device over the head of the user and said chin lobe is spaced from adjacent portions of adjacent said three lobes to provide spaces therebetween to facilitate donning and doffing of said device when said chin is aligned with one of said spaces and an inflatable bladder having a first bladder panel overlying a second bladder panel and closure seals sealing said bladder panels together around the outer periphery of said bladder panels and around the periphery of said three lobes of said neck opening to define said inflatable bladder.

2. A personal flotation device as defined in claim 1 wherein a first bladder defining seal connecting said bladder panels is provided extending on opposite sides of said chin lobe toward adjacent portions of said seals sealing said periphery of said bladder panels together to define a boundary between a chest support bladder portion and an, intermediate bladder portion and to provide a passage connecting said chest bladder portion and said intermediate bladder portion.

3. A personal flotation device as defined in claim 2 wherein a second bladder defining seal spaced from said first bladder defining seal extends on opposite sides of said neck opening from the end of said neck opening remote from said chin lobe toward adjacent portions of said seals sealing said periphery of said bladder panels together to define the boundary between said intermediate bladder portion and a back support bladder portion.

4. A personal flotation device as defined in claim 1 wherein a partition bladder panel is interposed between said first and second panels and said closure seals seal said first, second and intermediate bladder panels together around the periphery of said panels and around said neck opening to define said inflatable bladder as a pair of superimposed flotation bladders.

5. A personal flotation device as defined in claim 2 wherein a partition bladder panel is interposed between said first and second panels and said closure seals seal said first, second and intermediate bladder panels together around the periphery of said panels and around said neck opening to define said inflatable bladder as a pair of superimposed flotation bladders.

6. A personal flotation device as defined in claim 3 wherein a partition bladder panel is interposed between said first and second panels and said closure seals seal said first, second and intermediate bladder panels together around the periphery of said panels and around said neck opening to define said inflatable bladder as a pair of superimposed flotation bladders.

7. A personal flotation device as defined in claim 1 wherein said device further includes outer cover panels including a pair of chest protective panels one on each side of said inflatable bladder and a pair of back protective panels also position one on each side of said bladder.

8. A personal flotation device as defined in claim 7 wherein in a packaged position the periphery of said bladder is reverse folded to reduce the size of said inflatable bladder and is held in this form by said outer cover panels that are releasably held together by faster strips on the periphery of said cover panels.

9. A personal flotation device as defined in claim 2 wherein said device further includes outer cover panels including a pair of chest protective panels one on each side of said inflatable bladder and a pair of back protective panels also position one on each side of said inflatable bladder.

10. A personal flotation device as defined in claim 9 wherein in a packaged position the periphery of said inflatable bladder is reverse folded to reduce the size or said inflatable bladder and is held in this form by said outer cover panels that are releasably held together by faster strips on the periphery of said cover panels.

11. A personal flotation device as defined in claim 3 wherein said device further includes outer cover panels including a pair of chest protective panels one on each side of said inflatable bladder and a pair of back protective panels also position one on each side of said inflatable bladder.

12. A personal flotation device as defined in claim 11 wherein in a packaged position the periphery of said inflatable bladder is reverse folded to reduce the size of said in flatable bladder and is held in this form by said outer cover panels that are releasably held together by faster strips on the periphery of said cover panels.

13. A personal flotation device as defined in claim 4 wherein said device further includes outer cover panels including a pair of chest protective panels one on each side of said inflatable bladder and a pair of back protective panels also position one on each side of said inflatable bladder.

14. A personal flotation device as defined in claim 5 wherein said device further includes outer cover panels including a pair of chest protective panels one on each side of said inflatable bladder and a pair of back protective panels also position one on each side of said inflatable bladder.

15. A personal flotation device as defined in claim 6 wherein said device further includes outer cover panels including a pair of chest protective panels one on each side of said inflatable bladder and a pair of back protective panels also position one on each side of said inflatable bladder.

16. A personal flotation device as defined in claim 13 wherein each said bladder of said pair of superimposed bladders is provided with its inflation device and wherein said each of said chest protective cover panels is provided with window positioned so that its adjacent inflation device is visible therethrough.

17. A personal flotation device as defined in claim 14 wherein each said bladder of said pair of superimposed, bladders is provided with its inflation device and wherein said each of said chest protective cover panels is provided with window positioned so that its adjacent inflation device is visible therethrough.

18. A personal flotation device as defined in claim 15 wherein each said bladder of said pair of superimposed bladders is provided with its inflation device and wherein said each of said chest protective cover panels is provided with window positioned so that its adjacent inflation device is visible therethrough.

* * * * *